United States Patent [19]

Bouwens

[11] Patent Number: 4,786,937

[45] Date of Patent: Nov. 22, 1988

[54] PROCESSING CARTRIDGE WITH ONE TIME FUNCTION SHEET

[75] Inventor: Carl I. Bouwens, LeRoy, N.Y.

[73] Assignee: Xerox Corporation, Stamford, Conn.

[21] Appl. No.: 44,923

[22] Filed: May 1, 1987

[51] Int. Cl.[4] ..... G03G 21/00

[52] U.S. Cl. ..... 355/3 BE; 355/3 FU; 355/15

[58] Field of Search ..... 355/3 R, 3 FU, 3 BE, 355/16, 15

[56] References Cited

U.S. PATENT DOCUMENTS

| | | | |
|---|---|---|---|
| 3,706,491 | 12/1972 | Furman et al. | 355/133 |
| 3,979,761 | 9/1976 | Asano | 354/86 |
| 3,985,436 | 10/1976 | Tanaka et al. | 355/8 |
| 4,402,599 | 9/1983 | Seto | 355/15 X |
| 4,462,677 | 7/1984 | Onoda | 355/3 |
| 4,470,689 | 9/1984 | Nomura et al. | 355/3 |
| 4,478,512 | 10/1984 | Zolter | 355/3 |
| 4,544,260 | 10/1985 | Kolbe | 355/3 BE |
| 4,556,308 | 12/1985 | Hoppner et al. | 355/3 R |
| 4,566,777 | 1/1986 | Honda et al. | 355/3 R |
| 4,655,578 | 4/1987 | Kurtz et al. | 355/3 BE X |
| 4,690,544 | 9/1987 | Forbes et al. | 355/16 X |

OTHER PUBLICATIONS

IBM Technical Disclosure Bulletin, vol. 16, No. 11, Apr. 1974, p. 3558 by J. Maliwacki, Title: "Reusable Wiper".

*Primary Examiner*—Fred L. Braun

[57] ABSTRACT

Image forming apparatus includes a main body and a removably mountable processing cartridge containing at least one processing station useful in forming an image and having an opening therein and contained within the opening and extending therefrom a sheet-like member which provides a one time function to the processing cartridge or the main body of the image forming apparatus when it is withdrawn from the cartridge. In a new cartridge, the sheet-like member may be positioned in the cartridge between the imaging member and a cleaning blade and have on its surface a lubricant which upon withdrawal of the sheet-like member lubricates the cleaning nip between the cleaning blade and the imaging member. Alternatively, the sheet-like member may have a fuser release agent impregnated therein such that when a new cartridge is inserted in the main body of the image forming apparatus, it can be withdrawn from the cartridge by the fuser roll assembly thereby applying release agent to the fuser roll.

13 Claims, 4 Drawing Sheets

PROCESSING CARTRIDGE WITH ONE TIME FUNCTION SHEET

BACKGROUND OF THE INVENTION

The present invention relates to image forming apparatus and in particular to electrostatographic printing apparatus and more particularly to a processing cartridge which is removably mountable into the main body of such apparatus. More specifically, the present invention provides a new processing cartridge with a one time function discard sheet which provides a one time function to either the processing cartridge or the main body of the image forming apparatus when a new cartridge is inserted in the main body of the apparatus and the sheet is withdrawn.

In electrostatographic reproducing apparatus commonly used today a photoconductive insulating member is typically charged to a uniform potential and thereafter exposed to a light image of an original document to be reproduced. The exposure discharges the photoconductive insulating surface in exposed or background areas and creates an electrostatic latent image on the member which corresponds to the image contained within the original document. Alternatively, a light beam may be modulated and used to selectively discharge portions of the charged photoconductive surface to record the desired information thereon. Typically, such A system employs a laser beam. Subsequently, the electrostatic latent image on the photoconductive insulating surface is made visible by developing the image with developer powder referred to in the art as toner. Most development systems employ developer which comprises both charged carrier particles and charged toner particles which triboelectrically adhere to the carrier particles. During development the toner particles are attracted from the carrier particles by the charged pattern of the image areas of the photoconductive insulating area to form a powder image on the photoconductive area. This toner image may be subsequently transferred to a support surface such as copy paper to which it may be permanently affixed by heating or by the application of pressure.

In order to minimize maintenance costs by permitting the operator to replace worn out or exhausted processing units in electrostatographic apparatus, it has been suggested to incorporate one or more of the processing means of the apparatus in a disposable or removable cartridge. In this way, the operator can readily remove the cartridge when its operational life has been exhausted and insert a new cartridge. Many commercial applications employ this modular concept for the various processing stations. For example, the imaging member, developer assembly and cleaner assembly may be combined in a single unit or cartridge which has a limited life at the end of which it may be discarded and replaced with a new cartridge or unit. Alternatively, a charging device may be added to the unit or the unit may contain either of the developer or the cleaner. When replacing a used cartridge with a new cartridge, it may be necessary to perform one or more one time functions to enable the new cartridge to perform satisfactorily, to initiate functionality of processing elements, to rejuvenate a functional part of the main body of the apparatus or to provide an initial supply of some material to either the new cartridge or the main body of the apparatus. For example, in a new processing cartridge containing a cleaning system which includes a blade cleaner, it may be necessary to initially lubricate the cleaning nip formed between the blade tip and the imaging member. Alternatively, it may be desirable merely to initiate the functional relationship between the blade and the imaging member. If the nip is not adequately lubricated, there will be a relatively high coefficient of friction between the blade tip and imaging surface to such an extent that the edge or tip of the blade will tend to tuck under as the photoreceptor is moved relative thereto thereby causing a cleaning failure which may only be capable of being remedied by replacement of the cartridge with a new cartridge. In addition, in such apparatus wherein a roll fuser is used and contained within the main body of the apparatus, it may be desirable to provide an initial image of a release agent such as silicone oil to the fuser roll on insertion of a new processing cartridge.

PRIOR ART

U.S. Pat. No. 3,985,436 to Tanaka et al. describes a replaceable cartridge for use in electrostatographic imaging apparatus which contains a photoreceptor, a developing device and a cleaning device as well as a corotron which maybe releasably inserted into the copying machine. This cartridge is positioned in the machine by being inserted from one side thereof and having cooperative elements on the cartridge which are guided by guide members on the main frame of the machine.

U.S. Pat. No. 4,556,308 to Hoppner et al. and U.S. Pat. No. 4,544,260 to Kolbe illustrate removable processing cartridges containing photoreceptor belts which may be inserted in the operational position in the machine when the top of the machine is opened up.

U.S. Pat. No. 4,462,677 to Onoda describes a processing cartridge including a protection cover for photoreceptor which is movable between a closed protection position and an open operational position in associated with opening a paper path to the image receiving material.

U.S. Pat. No. 4,470,689 to Nomura et al. describes a detachably mounted processing unit including an image bearing member and a protection cover therefor which is movable to the closed position in association with separation of the process unit from the operative position in the main assembly.

U.S. Pat. No. 3,706,491 to Furnam et al. discloses a method for cleaning a fuser roll wherein a plain piece of paper is passed through the fuser roll couple at a slow rate while a back-up roll is heated above a toner melting temperature. Accumulated toner on the back of the roll becomes soft and adheres to the plain paper.

IBM Technical Disclosure Bulletin, Vol. 16, No. 11, 1974, Page 3558 by Maliwacki teaches a reusable wiper design to clean transparent windows of a document processing machine. The device is constructed of ordinary card stock and provided with a urethane foam sponge on one end. The wiper is inserted in the machine in the same manner as a regular document. As the wiper element on the trailing edge of the device passes windows of the machine the windows are cleaned of dust buildup and the like.

SUMMARY OF THE INVENTION

The present invention is directed to a processing cartridge which is removably mounted into the main body of an image forming apparatus which comprises a housing containing therein at least one processing means useful in forming an image and has an opening therein and contained within the opening and extending therefrom a sheet-like member which provides a one time function to either the processing cartridge or the main body of the image forming apparatus when the sheet is withdrawn from the cartridge.

In a specific aspect of the present invention, the processing cartridge includes an imaging member upon which a developed toner image may be formed and a cleaning blade for removing residual toner from the imaging member in preparation for the next imaging cycle and the sheet like member is positioned between the imaging member and the cleaning blade which upon withdrawal of the sheet-like member initiates the functional relationship between the cleaning nip between the cleaning blade and the imaging member.

In a further aspect of the present invention, the sheet-like member has a lubricant thereon to lubricate the cleaning nip upon withdrawal of the sheet through the nip.

In a further aspect of the present invention, the sheet-like member is withdrawn from the cartridge by means on the main body of the image forming apparatus when the cartridge is placed in its operational position in the main body of the image forming apparatus and an imaging cycle is initiated.

In a further aspect of the present invention, the withdrawal means comprises rotatable fuser and pressure rolls forming a nip therebetween such that upon insertion of the processing cartridge into the main body the lead edge of the sheet-like member extending from the cartridge is engaged by the fuser nip whereby on initiation of a copying cycle, the sheet like member is withdrawn from the processing cartridge by the fuser and pressure roll and transported through the main body of the apparatus.

In a further aspect of the present invention, the sheet-like member contains a fuser release agent therein so that when the sheet-like member is withdrawn from the cartridge through the fuser and pressure roll nip in the main body of the apparatus, release agent is applied to the fuser roll.

DESCRIPTION OF THE PREFERRED EMBODIMENT

The invention will now be described with reference to a preferred embodiment of the processing cartridge with the one time function discard sheet and an electrostatographic reproducing apparatus.

Figure 1:
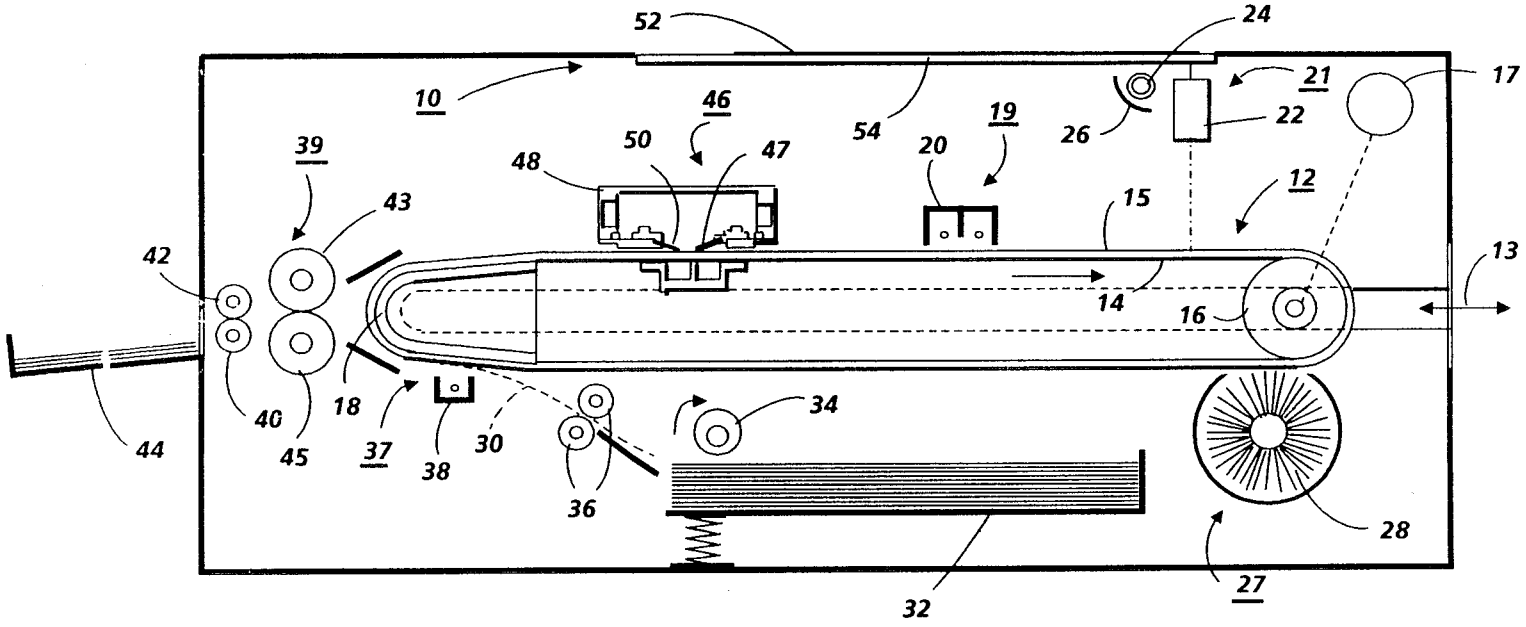
FIG. 1 is a schematic representation in cross section of an automatic electrostatographic reproducing machine employing a processing cartridge which may be inserted therein according to the present invention.

Referring now to FIG. 1, there is shown by way of example, an automatic electrostatographic reproducing machine 10 which includes a removable processing cartridge according to the present invention. The reproducing machine depicted in FIG. 1 illustrates the various components utilized therein for producing copies from an original document. Although the apparatus of the present invention is particularly well adapted for use in automatic electrostatographic reproducing machines, it should become evident from the following description that it is equally well suited for use in a wide variety of processing systems including other electrostatographic systems and is not necessarily limited in application to the particular embodiment shown herein.

The reproducing machine 10 illustrated in FIG. 1 employs a removable processing cartridge 12 which may be inserted and withdrawn from the main machine frame in the direction of arrow 13. Cartridge 12 includes an image recording belt like member 14 the outer periphery of which is coated with a suitable photoconductive material 15. The belt is suitably mounted for revolution within the cartridge about driven transport roll 16, around belt tracking shoe 18 and travels in the direction indicated by the arrows on the inner run of the belt to bring the image bearing surface thereon past the plurality of xerographic processing stations. Suitable drive means such as motor 17 are provided to power and coordinate the motion of the various cooperating machine components whereby a faithful reproduction of the original input scene information is recorded upon a sheet of final support material 30, such as paper or the like.

Initially, the belt 14 moves the photoconductive surface 15 through a charging station 19 wherein the belt is uniformly charged with an electrostatic charge placed on the photoconductive surface by charge corotron 20 in known manner preparatory to imaging. Thereafter the belt 14 is driven to exposure station 21 wherein the charged photoconductive surface 15 is exposed to the light image of the original input scene information, whereby the charge is selectively dissipated in the light exposed regions to record the original input scene in the form of electrostatic latent image. The exposure station 21 may comprise a bundle of image transmitting fiber lenses 22 produced under the tradename of "SELFOC" by Nippon Sheet Glass Company Limited, together with an illuminating lamp 24 and a reflector 26. After exposure of the belt 15 the electrostatic latent image recorded on the photoconductive surface 15 is transported to development station 27, wherein developer is applied to the photoconductive surface of the drum 15 rendering the latent image visible. Suitable development station could include a magnetic brush development system including developer roll 28, utilizing a magnetizable developer mix having coarse magnetic carrier granules and toner colorant particles.

Sheets 30 of the final support material are supported in a stack arrangement on elevated stack support tray 32. With the stack at its elevated position, the sheet separator segmented feed roll 34, feeds individual sheets therefrom to the registration pinch roll pair 36. The sheet is then forwarded to the transfer station 37 in proper registration with the image on the belt and the developed image on the photoconductive surface 15 is brought into contact with the sheet 30 of final support material within the transfer station 37 and the toner image is transferred from the photoconductive surface 15 to the contacting side of the final support sheet 30 by means of transfer corotron 38. Following transfer of the image, the final support material which may be paper, plastic, etc., as desired, is separated from the belt by the beam strength of the support material 30 as it passes around the arcuate face of the belt tracking shoe 18, with the sheet containing the toner image thereon which is advanced to fixing station 39 composed of fuser roll 43 and pressure roll 45 forming a fusing nip therebetween wherein roll fuser 43 fixes the transferred powder image thereto. After fusing the toner image to the copy sheet, the sheet 30 is advanced to output rolls 40 and 42 to sheet stacking tray 44.

Although a preponderance of toner powder is transferred to the final support material 30, invariably some residual toner remains on the photoconductive surface 15 after the transfer of the toner powder image of the final support material. The residual toner particles remaining on the photoconductive surface after the transfer operation are removed from the belt 14 by the cleaning station 46 which comprises a cleaning blade 47 in scraping contact with the outer periphery of the belt 14 and contained within cleaning housing 48 which has a cleaning seal 50 associated with the upstream opening of the cleaning housing.

Normally when the copier is operated in the conventional mode, the original document 52 to be reproduced is placed image side down upon a horizontal transport viewing platen 54 which transports the original past the exposure station 21. The speed of the moving platen and the speed of the photoconductive belt are synchronized to provide a faithful reproduction of the original document.

It is believed that the foregoing general description is sufficient for the purposes of the present application to illustrate the general operation of an automatic xerographic copier 10 which can embody the apparatus in accordance with the present invention.

Figure 2:
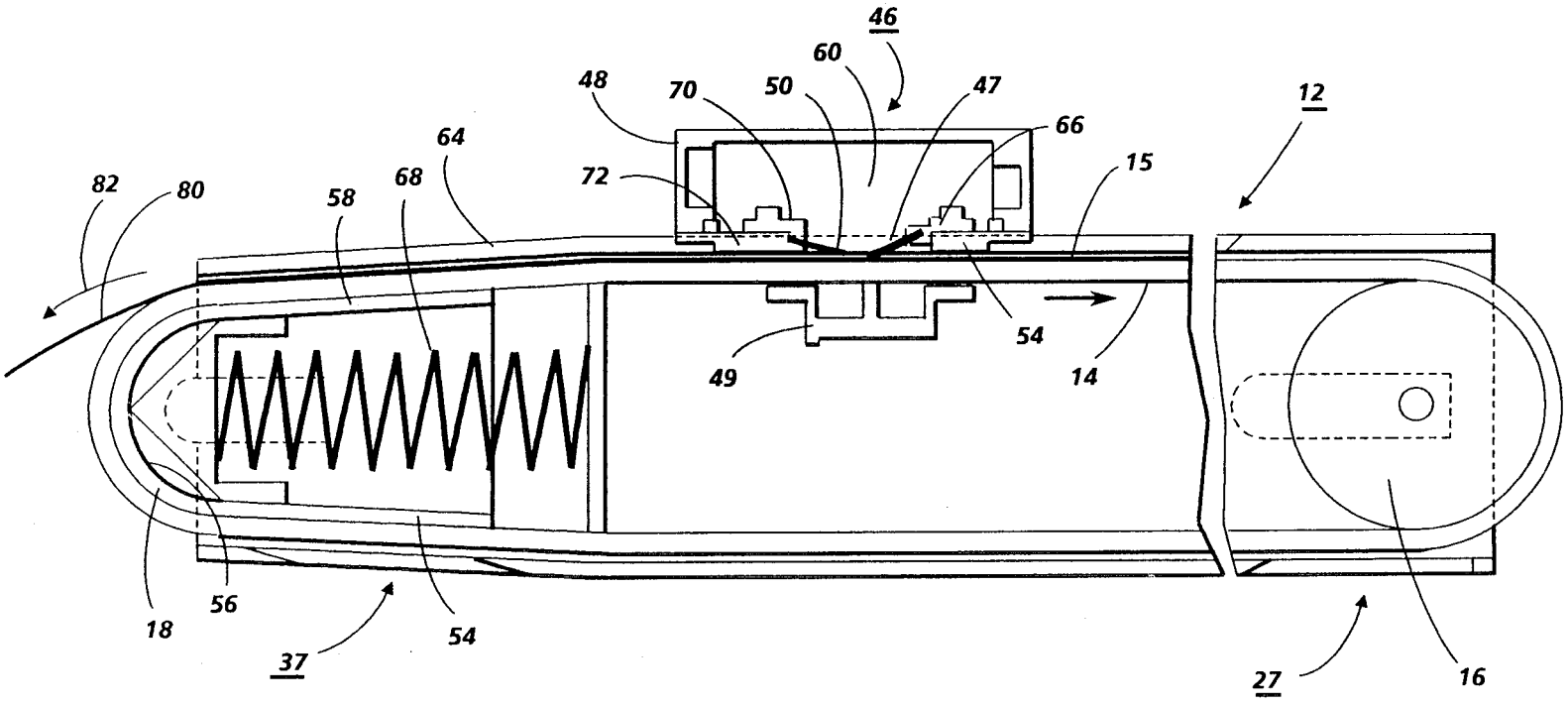
FIG. 2 is an enlarged schematic representation in cross section of a processing cartridge with the one time function discard sheet contained therein.

The removable disposable processing cartridge with the one time function discard sheet will be described in greater detail with specific reference to FIGS. 2 through 4. FIG. 2 illustrates a removable processing cartridge which includes a photoreceptor belt 14 and cleaning housing 48 contained within a cartridge housing 64. The belt 14 is suitably mounted for revolution within the cartridge about driven transport roll 16 which is driven by the main machine drive (not shown) around the belt tracking shoe 18 and travels in the direction indicated by the arrows on the inner run of the belt to bring the image bearing surface thereon past the plurality of xerographic processing stations. The belt tracking shoe 18 comprises a first substantially horizontal path defining surface 54, an arcuate path defining surface 56 and a second substantially planer path defining surface 58 which may or may not be substantially parallel to the planer surface 54 which path is continuous to enable the belt to be reversed in direction by being transported therearound. The belt tracking shoe is urged toward the left to apply belt tensioning force by means of springs 68. For further details of the belt tracking shoe, attention is directed to U.S. Pat. No. 4,657,370. The cleaning housing 48 comprises a cleaning platen 49 positioned under the top horizontal run of the imaging belt 14 with the cleaning sump in opposed relationship on the top run of the photoconductive belt 14. Contained within the cleaner housing is a cleaning blade 47 rigidly held in a blade holder which is mounted to blade mount 66 which in turn is mounted to the cleaning housing 48. The cleaning blade 47 by virtue of its position and beam deflection is in opposed interference relationship with the top surface of belt 14 supported by cleaning platen 49. Cleaning seal 50 is held by its seal holder 70 which is mounted to seal mount 72 upstream in the process direction of the cleaning blade. The seal in contact with the photoreceptor 14 insures that toner cleaned from the photoreceptor by the cleaning blade does not escape in the upstream direction from the cleaning housing. As the photoreceptor 14 travels in the direction of the arrow any residual toner remaining thereon is cleaned or scraped from the imaging surface by the blade 47 and transported into the cleaning sump 60. While the cleaning blade is illustrated as being in a chiseling orientation with regard to the advancing photoreceptor belt, it will be understood that it could equally well be used in a wiping orientation with respect to the advancing photoreceptor belt.

Figure 3:
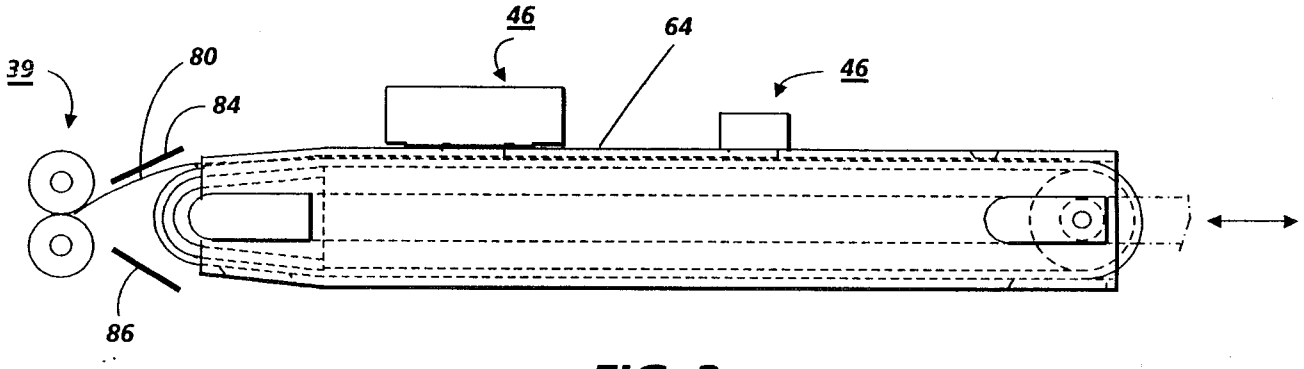
FIG. 3 is a partial schematic representation in cross section of a processing cartridge having a one time function discard sheet for lubricating the nip between the cleaning blade and the photoreceptor belt on insertion into the main body of the apparatus.

In a new cartridge, a single function discard sheet 80 is interposed between the cleaning housing and the photoreceptor belt and has a leading edge or leader extending out of the front end of the cartridge as illustrated in FIGS. 2 and 3. Alternatively, the single function discard sheet may be along the bottom run of the belt passing through the transfer zone of the cartridge as illustrated in FIG. 4. The single function discard sheet may be used to initiate the functional relationship in a new cartridge between the cleaning blade and the photoreceptor belt merely by having the sheet pulled through the blade/belt nip. For example, the single function discard sheet may have a thin film of a lubricant sprayed on its surface which when pulled through the nip provides the desired lubricating action for start up of a new cartridge. Alternatively, the single function discard sheet has applied to it a particulate lubricant material to lubricate the cleaning nip between the cleaning blade and the photoreceptor belt when the single function discard sheet is pulled from the cartridge through the cleaning station in the direction of the arrow 82. Furthermore, the single function discard sheet may be used to prevent damage to the photoreceptor belt by the blade edge during shipping and/or long time storage.

Figure 4:
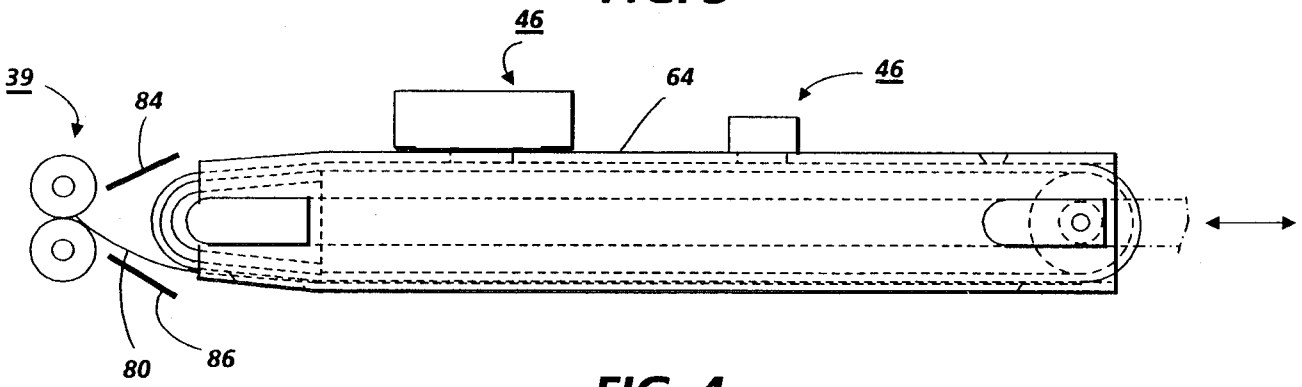
FIG. 4 is a partial schematic representation in cross section of a processing cartridge with a one time function discard sheet with fuser release agent therein to provide an initial supply of release agent to the fuser roll an insertion into the main body of the apparatus.
Figure 5:
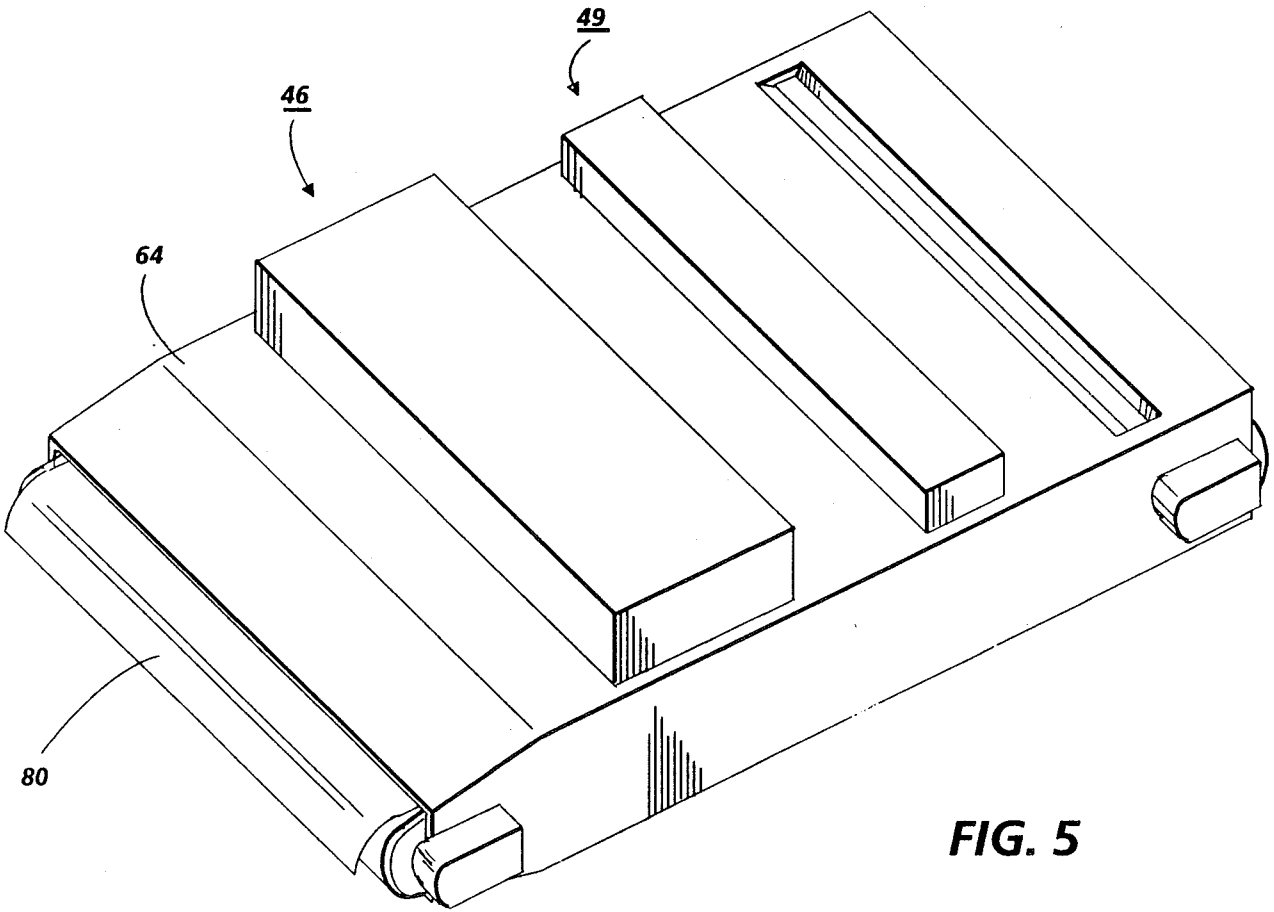
FIG. 5 is an isometric view of a new processing cartridge with the lead edge of the one time discard sheet extending from the front thereof.

While the one time function discard sheet may be manually pulled from the cartridge by physically gripping the leader of the sheet and pulling it through the cleaning station out of the cartridge, FIGS. 3 and 4 illustrate a more conventional mode in which the one time function discard sheet can be automatically withdrawn from the cartridge thereby activating the cartridge for use. FIG. 3 schematically illustrates the insertion of a new processing cartridge into the main body of the reproducing apparatus from the end of the reproducing apparatus. Upon insertion of a new cartridge into the machine, the cartridge is docked in the appropriate position and locked in place by means not shown. During insertion, the leader edge of the one time function discard sheet is gently guided into the nip between the fuser roll and the pressure roll. Sheet guide baffles 84 and 86 may be used for this purpose. Upon initiating a copying cycle the leader of the one time function discard sheet is engaged by the nip formed between the pressure roll and the fuser roll and withdrawn through the cleaning housing from the cartridge and discarded in paper tray 44. As a result of being withdrawn through the cleaning housing, the lubricant present on the one time function discard sheet will lubricate the interface between the cleaning blade tip and the photoreceptor. In this regard, it should be noted that any lubricant that may be present on the downstream side of the cleaning blade or on the photoreceptor belt will be cleaned therefrom on the next pass of the belt through the cleaner housing.

The one time function discard sheet may be made of any suitable material. Typically, bond paper or card stock having sufficient beam strength to provide an urging action to the lead edge of the sheet into the fuser nip may be used. In addition, plastic substrate may be utilized.

The lubricant applied to the one time discard sheet may be any lubricant which is suitable in lubricating the interface between the photoreceptor belt and the cleaning blade tip. Typical materials include tetrafluoroethylene, polyvinyldine fluoride, copolymers of tetrafluoroethylene and hexafluoropropylene or vinylidene fluoride as are well known in the art. While these lubricants may be provided in particulate form themselves on the one time function discard sheet, it is preferred to employ a toner containing a lubricant therein for this purpose. Accordingly, a small amount of toner particles used in the functional operation of the processing cartridge may be present on the one time function discard sheet to provide the necessary lubricating action between the photoreceptor and the cleaning blade tip at initiation of a new cartridge. Typically less than about 1/4 gram of lubricant is applied across the width of the one time function discard sheet to which it may be electrostatically or adhesively held. The lubricant is removed by the force of the cleaning blade edge. The cleaning seal may also assist in scraping off lubricant. Typically about one half of the lubricant is removed on each side of the blade edge.

FIG. 4 illustrates an alternative embodiment wherein the one time function discard sheet is employed to provide a one time function to the main body of the image forming apparatus. In FIG. 4, the one time function discard sheet is provided with a supply of fuser release agent which is used to provide an initial supply of release agent to the fuser roll on insertion of a new cartridge when the sheet is withdrawn from the cartridge through the fusing nip in the same manner as described with reference to FIG. 3. For this application, the one time function discard sheet can have small capsules of release agent on the surface thereof which are crushed during passage through the fuser nip thereby releasing the release agent. Alternatively, the one time function discard sheet may be sufficiently porous to contain adequate quantities of the release agent to supply to the fuser roll when withdrawn through the nip. With this option, care should be exercised to insure that the fuser release agent does not contaminate the photoreceptor or cleaner. The release agent supplied may be any of those typically used in the practice of automatic electrostatographic reproducing machines. Typically, the release agents are silicone oils such as polydimethylsiloxane oils having viscosities of from about 10,000 to 60,000 centistokes.

Accordingly, the present invention provides a relatively simple and inexpensive manner in which to activate a new processing cartridge when inserted into the main body of the machine or to provide a one time function to the main body of the machine upon insertion of a new processing cartridge. In one embodiment, it has the advantage of minimizing the frequency of blade tuck under and thereby cleaning blade failure in a new processing cartridge employing a cleaning blade to remove residual toner from the imaging member surface. In another embodiment, it can provide an initial supply of release agent to the fuser roll on insertion of a new processing cartridge.

The disclosures of the patents referred to herein are hereby specifically and totally incorporated herein by reference.

While the invention has been described with reference to specific embodiments it will be apparent to those skilled in the art that many alternatives, modifications and variations may be made. For example, while the processing cartridge has been illustrated as employing a photoreceptor belt, it will be understood that the present invention has application in processing cartridges employing photoreceptor drums. In addition, while the one time function discard sheet has been illustrated and described as providing a single function to either a new processing cartridge upon insertion into the main body of the apparatus or a single function to the main body of the apparatus, it will be understood that plural functions could be performed by this one time function discard sheet. In addition, while the invention has been described with a specific reference to an automatic copying machine, it will be understood that it has equal application to printers. Accordingly, it is intended to embrace all such alternatives and modifications as may fall within the spirit and scope of the appended claims.

I claim:

1. A processing cartridge removably mountable into the main body of an image forming apparatus comprising a housing containing therein processing means useful in forming an image including an imaging member upon which a developed toner image may be formed and a cleaning blade for removing residual toner from said imaging member preparatory to the next imaging cycle, said housing having an opening therein and within the opening and extending therefrom a sheet-like member which is positioned between said imaging member and said cleaning blade and which upon withdrawal of said sheet-like member initiates the functional relationship between the cleaning blade and the imaging member.

2. The processing cartridge of claim 1 wherein said sheet-like member is capable of being manually withdrawn from the cartridge.

3. The processing cartridge of claim 1 wherein said sheet-like member is withdrawn from the cartridge by the main body of the image forming apparatus when the cartridge is placed in its operational position in the main body of the image forming apparatus and an imaging cycle is initiated.

4. The processing cartridge of claim 1 wherein said sheet-like member positioned between said imaging member and said cleaning blade has a lubricant thereon which upon withdrawal of said sheet-like member lubricates the cleaning nip between the cleaning blade and the imaging member.

5. The processing cartridge of claim 4 wherein said imaging member comprises an endless belt having a photoconductive insulating surface.

6. The processing cartridge of claim 4 wherein said lubricant is particulate toner.

7. Image forming apparatus comprising a main body and a removably mountable processing cartridge comprising a housing containing therein processing means useful in forming an image including an imaging member upon which a developed toner image may be formed and a cleaning blade for removing residual toner from said imaging member preparatory to the next imaging cycle, said housing having an opening therein and contained within the opening and extending therefrom a sheet-like member which is positioned between said imaging member and said cleaning blade and which upon withdrawal of said sheet-like member initiates the functional relationship between the cleaning blade and the imaging member, said main body including means to withdraw said sheet-like member from said cartridge.

8. The apparatus of claim 7 wherein said withdrawal means comprises rotatable fuser and pressure rolls forming a nip therebetween and wherein on insertion of said processing cartridge in said main body the lead edge of said sheet-like member extending from said cartridge is engaged by said fuser nip whereby on initiation of a copying cycle said sheet like member is withdrawn from the processing cartridge by said fuser and pressure roll and transported through the main body of the apparatus.

9. The apparatus of claim 8 wherein said imaging member comprises an endless belt having a photoconductive insulating surface.

10. The apparatus of claim 7 wherein said sheet-like member positioned between said imaging member and said cleaning blade has a lubricant thereon which upon withdrawal of said sheet-like member lubricates the cleaning nip between the cleaning blade and the imaging member.

11. The apparatus of claim 10 wherein said lubricant is particulate toner.

12. A processing cartridge removably mountable into the main body of an image forming apparatus comprising a housing containing therein processing means useful in forming an image including an imaging member upon which a developed toner image may be formed, said housing having an opening therein and within the opening and extending therefrom a sheet-like member which is withdrawn from the cartridge by the main body of the image forming apparatus when the cartridge is placed in its operational position in the main body of the image forming apparatus and an imaging cycle is initiated, said sheet-like member containing a fuser release agent and being withdrawable from the cartridge through the nip formed between the fuser roll and pressure roll in the main body of the apparatus thereby providing an initial supply of fuser release agent to the fuser roll.

13. Image forming apparatus comprising a main body and a removably mountable processing cartridge comprising a housing containing therein processing means useful in forming an image including an imaging member upon which a developed toner image may be formed, said housing having an opening therein and contained within the opening and extending therefrom a sheet-like member containing a fuser release agent, said main body including means to withdraw said sheet-like member from said cartridge comprising rotatable fuser and pressure rolls forming a nip therebetween and wherein on insertion of said processing cartridge in said main body the lead edge of said sheet-like member extending from said cartridge is engaged by said fuser nip whereby on initiation of a copying cycle said sheet-like member is withdrawn from the processing cartridge by said fuser and pressure roll and transported through the main body of the apparatus and fuser release agent is applied to said fuser roll.

* * * * *